United States Patent [19]

Kanno et al.

[11] Patent Number: 5,066,945

[45] Date of Patent: Nov. 19, 1991

[54] DRIVING APPARATUS FOR AN ELECTRODE MATRIX SUITABLE FOR A LIQUID CRYSTAL PANEL

[75] Inventors: Hideo Kanno, Kawasaki; Hiroshi Inoue, Yokohama; Atsushi Mizutome, Fujisawa, all of Japan

[73] Assignee: Canon Kabushiki Kaisha, Tokyo, Japan

[21] Appl. No.: 262,576

[22] Filed: Oct. 25, 1988

[30] Foreign Application Priority Data

Oct. 26, 1987 [JP] Japan ..... 62-271120
Nov. 12, 1987 [JP] Japan ..... 62-284158

[51] Int. Cl.[5] ..... G09G 3/36

[52] U.S. Cl. ..... 340/784; 340/805; 340/811; 359/56

[58] Field of Search ..... 340/765, 784, 805, 811, 340/812, 813; 350/331 T, 332, 333, 350 S; 358/230, 236

[56] References Cited

U.S. PATENT DOCUMENTS 4,186,436 1/1980 Ishiwatari ..... 363/60
4,532,504 7/1985 Fisher ..... 340/739
4,548,476 10/1985 Kaneko ..... 350/350 S
4,622,590 11/1986 Togashi ..... 340/811
4,622,635 11/1986 Chandra et al. ..... 350/331 T
4,655,561 4/1987 Kanbe et al. ..... 350/350 S
4,709,995 12/1987 Kuribayashi et al. ..... 350/350 S
4,714,921 12/1987 Kanno et al. ..... 340/805
4,769,639 9/1988 Kawamura et al. ..... 340/811

FOREIGN PATENT DOCUMENTS 2188471 9/1987 United Kingdom .

OTHER PUBLICATIONS

I.E.E.E. Transactions on consumer Electronics, vol. CE-28, No. 3, Aug. 1982, pp. 196-200, Fujii, T., et al. "Dot Matrix LCD Module For Graphic Display".

*Primary Examiner*—Jeffery A. Brier
*Attorney, Agent, or Firm*—Fitzpatrick, Cella, Harper & Scinto

[57] ABSTRACT

A driving apparatus comprises a driving unit and a drive voltage generating unit. The driving unit includes a scanning electrode driver and a data electrode driver for driving an electrode matrix formed of scanning electrodes and data electrodes. The drive voltage generating unit includes a first means for generating a fixed voltage, a second means for generating a source voltage for providing drive voltages for driving the electrode matrix, and a third means for generating a first voltage equal to a subtraction of the fixed voltage from the source voltage and a second voltage equal to a subtraction of the source voltage from the fixed voltage. The first and second voltages are preferably controlled so as to vary depending on an external temperature.

40 Claims, 13 Drawing Sheets

DRIVING APPARATUS FOR AN ELECTRODE MATRIX SUITABLE FOR A LIQUID CRYSTAL PANEL

FIELD OF THE INVENTION AND RELATED ART

The present invention relates to a driving apparatus, particularly a drive voltage generating apparatus for a ferroelectric liquid crystal panel.

A conventional drive voltage generating apparatus for multiple driving a TN (twisted nematic) liquid crystal panel has a system, as shown in FIG. 9, comprising a plurality of resistors $R_1$ and $R_2$ ($R_1 \neq R_2$) connected in series between voltage supplies $V_{DD}$ and $V_{SS}$ in a drive unit so as to generate voltages $V_{12}$, $V_{13}$, $V_{14}$, $V_{15}$ and $V_{16}$ determined by voltage division of a voltage $V_{11}$ ($=V_{DD}-V_{SS}$) according to the plurality of resistors $R_1$ and $R_2$. Then, a scanning electrode driver is supplied with the voltages $V_{11}$, $V_{12}$, $V_{15}$ and $V_{16}$, and a data electrode driver is supplied with the voltages $V_{11}$, $V_{12}$, $V_{13}$ and $V_{14}$. The scanning electrode driver supplies a scanning selection pulse with a voltage $V_{11}$ and a scanning non-selection pulse with a voltage $V_{15}$ to scanning electrodes in an odd-numbered frame operation, and a scanning selection pulse with a voltage $V_{12}$ of an opposite polarity to the voltages $V_{11}$ and $V_{15}$, with respect to the voltage level $V_{SS}$ as the standard, and a scanning non-selection pulse with a voltage $V_{16}$ to the scanning electrodes in even-numbered frame operations. On the other hand, the data electrode driver supplies a data selection pulse voltage $V_{12}$ and a data non-selection pulse voltage $V_{13}$ to the data electrodes in synchronism with the scanning selection pulse $V_{11}$ in the odd frame, and a data selection pulse voltage $V_{11}$ of an opposite polarity to the voltages $V_{12}$ and $V_{13}$, with respect to the voltage level $V_{SS}$, and a data non-selection pulse voltage $V_{14}$ to the data electrodes in synchronism with the scanning selection pulse voltage $V_{12}$ in the even frame.

The system shown in FIG. 9 further includes a trimmer Rv for changing the application voltage which may be used for adjusting a contrast of the display panel. More specifically, by adjusting the application voltage trimmer Rv, the voltage levels $V_{12}-V_{16}$ can be varied with the voltage level $V_{11}$ at the maximum so that the voltages applied to the liquid crystal panel can be varied.

The scanning electrode driver and data electrode driver are supplied with supply voltages ($V_{DD}-V_{SS}$), and the voltage applied to a liquid crystal pixel at the time of selection becomes $V_{11}-V_{12}$, so that the maximum voltage applied to a liquid crystal pixel depends on the withstand voltage of the drive unit.

On the other hand, various driving methods have been proposed for driving a ferroelectric liquid crystal panel. In the methods described in U.S. Pat. Nos. 4,548,476 and 4,655,561, for example, the scanning electrode driver and data electrode driver supply driving waveforms including voltages $V_{11}$, $V_{12}$, $V_{13}$ and $V_{14}$ satisfying fixed ratios of $V_{11}:V_{12}:V_{13}:V_{14}=2:1:1$ with respect to the scanning non-selection signal voltage Vc wherein $V_{11}$ and $V_{12}$ and also $V_{13}$ and $V_{14}$ are respectively of mutually opposite polarities with respect to the voltage Vc. The amplitude of the scanning selection signal voltage is ($V_{11}-V_{12}$), and the amplitude of the data selection or non-selection signal voltage is ($V_{13}-V_{14}$), that is ($V_{11}-V_{12}$)/2. Now, if it is assumed that the voltage $V_{11}$ is fixed as the highest voltage and division voltages $V_{13}$, Vc, $V_{14}$ and $V_{12}$ are generated as in the above-mentioned drive of a TN-type liquid crystal panel, and the division voltages are used for driving a ferroelectric liquid crystal panel, the maximum voltage applicable to a pixel is ($V_{11}-V_{14}$). More specifically, if $V_{DD}-V_{SS}=22$ volts, the respective voltages will be such that $V_{11}=22$ volts, $V_{13}=16.5$ volts, Vc=11 volts, $V_{14}=5.5$ volts and $V_{12}=0$ volt, and the maximum voltage applied to a pixel will be ($V_{11}-V_{14}$)=16.5 volts.

In this way, if the driving of a TN-type liquid crystal panel and that of a ferroelectric liquid crystal panel are composed, a driving unit of the same withstand voltage provides a smaller maximum voltage applicable to a pixel for a ferroelectric liquid crystal panel because of the difference between the driving methods.

The characteristics required of a ferroelectric liquid crystal panel include a higher switching speed and a wider dynamic temperature range are required, which largely depend on applied voltages. FIG. 11 illustrates a relationship between the drive voltage and the application time, and FIG. 12 illustrates a relationship between the temperature and the drive voltage. More specifically, in FIG. 11, the abscissa represents the voltage V (voltage applied to a pixel shown in FIG. 10), the ordinate represents the pulse duration $\Delta T$ (pulse duration shown in FIG. 10 required for inverting the orientation at a pixel), and the dependence of the pulse duration $\Delta T$ on the charge in drive voltage V is illustrated. As shown in the figure, the pulse duration can be shortened as the drive voltage becomes higher. Next, in FIG. 12, the abscissa represents the temperature (Temp.), the ordinate represents the drive voltage (log V) in a logarithmic scale, and the dependence of the threshold voltage Vth on the temperature change is shown at a fixed pulse duration $\Delta T$. As shown in the figure, a lower temperature requires a higher driving voltage. It is understood from FIGS. 11 and 12 that an increased voltage applicable to a pixel allows for a higher switching speed and a wider dynamic or operable temperature range.

On the other hand, designing of a drive unit (IC) having an increased withstand voltage for providing a required drive voltage results in a slow operation speed of a logic circuit in the data electrode driver. This is because designing for providing an increased withstand voltage generally requires an enlargement in pattern width and also in size of an active element in the drive unit (IC) to result in increased capacitance which leads to increased propagation delay time. Such a slow operation speed results in a decrease in the amount of image data transferable in a fixed period (horizontal scanning period), so that it becomes difficult to realize a large size and highly fine liquid crystal display with a large number of pixels.

As is further understood from FIGS. 11 and 12, appropriate temperature compensation must be effected with respect to drive voltage control with a consideration on threshold voltage, etc. In temperature compensation with respect to a drive voltage control, it is particularly to be noted that mutually related drive conditions such as the pulse duration $\Delta T$ and the drive voltage are largely changed depending on temperature, and such drive conditions allowable at a prescribed temperature are restricted to a narrow range. It is extremely difficult to manually control the pulse duration, drive voltage, etc., accurately in accordance with a change in temperature.

SUMMARY OF THE INVENTION

With the above described difficulties in view, it is an object of the present invention to provide a voltage generating apparatus which allows the supply of an effectively large maximum drive voltage within a withstand voltage of a data electrode driver without a substantial increase of the withstand voltage, and also a driving apparatus using the same.

Another object of the present invention is to provide a driving apparatus suitable for realization of an appropriate temperature compensation.

According to a principal aspect of the present invention, there is provided a driving apparatus comprising:

a) a driving unit including a scanning electrode driver and a data electrode driver for driving an electrode matrix formed of scanning electrodes and data electrodes, and b) a drive voltage generating unit including a first means for generating a fixed voltage, a second means for generating a source voltage for providing drive voltages for driving the electrode matrix, and a third means for generating a first voltage equal to a subtraction of the fixed voltage from the source voltage and a second voltage equal to a subtraction of the source voltage from the fixed voltage.

According to another aspect of the present invention, there is provided the driving apparatus further provided with an appropriate temperature compensation means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
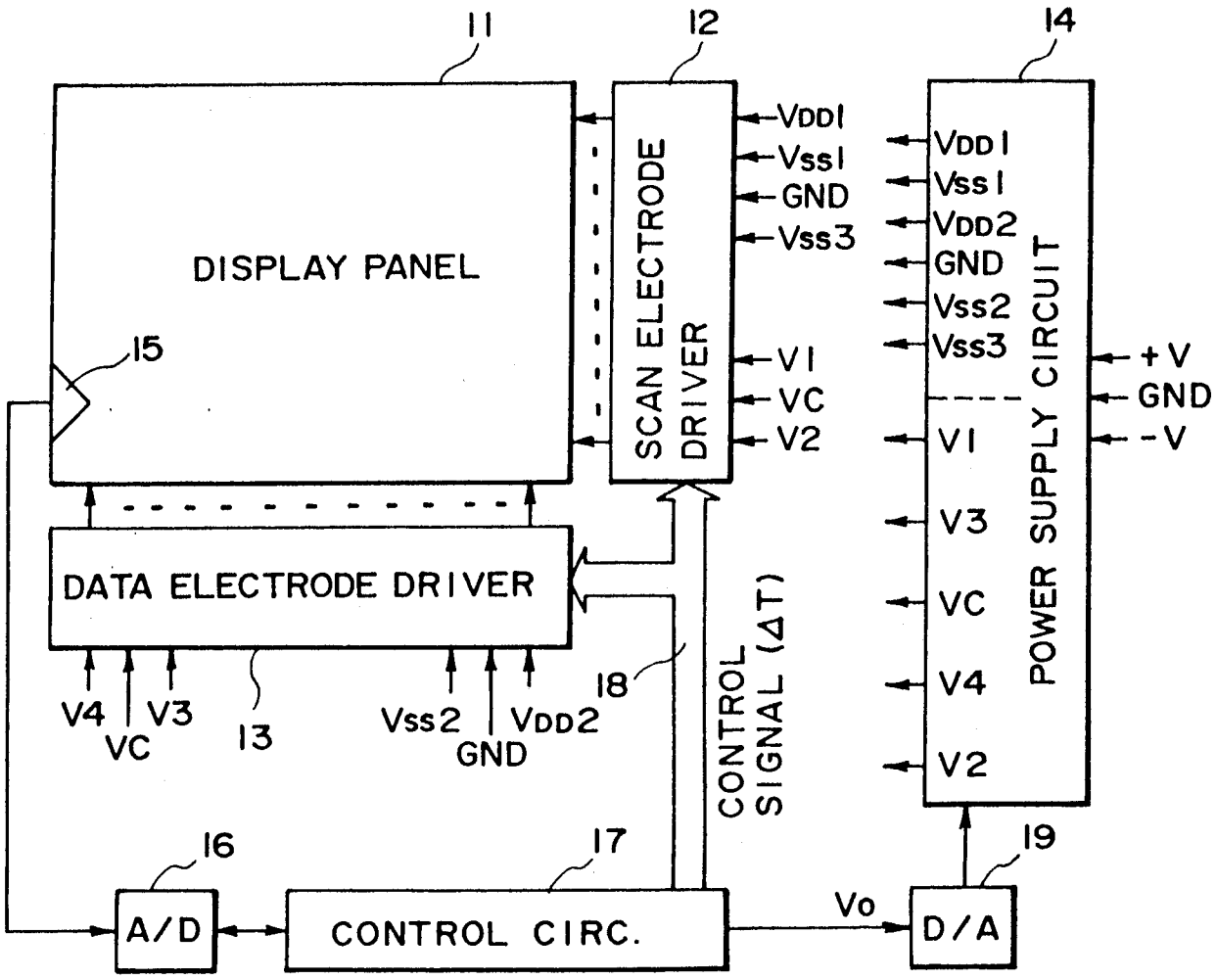
FIG. 1 is a block diagram of a display apparatus using a driving apparatus according to the present invention.

FIG. 1 is a block diagram showing a driving apparatus of the present invention. A display panel 11 includes a matrix electrode structure comprising scanning electrodes and data electrodes intersecting each other. Each intersection of the scanning electrodes and data electrodes constitutes together with a ferroelectric liquid crystal disposed between the scanning electrodes a pixel and data electrodes. The orientation of the ferroelectric liquid crystal at each pixel is modulated or controlled by the polarity, of the drive voltage applied to the pixel. The scanning electrodes in the display panel 11 are connected to a scanning electrode driver 12, and the data electrodes are connected to a data electrode driver 13.

Voltages (or potentials) $V_{DD1}$, $V_{SS1}$, $V_{DD2}$, GND, $V_{SS2}$ and $V_{SS3}$ required for operation of the scanning electrode driver 12 and the data electrode driver 13, and the voltages (or potentials) $V_1$, $V_3$, Vc, $V_4$ and $V_2$ required for operation of the display panel 11 are supplied from a power supply circuit 14 to a driving unit including the scanning electrode driver 12 and the data electrode driver 13. Further, the power supply circuit 14 is supplied with two external supply voltages +V and −V.

Figure 2:
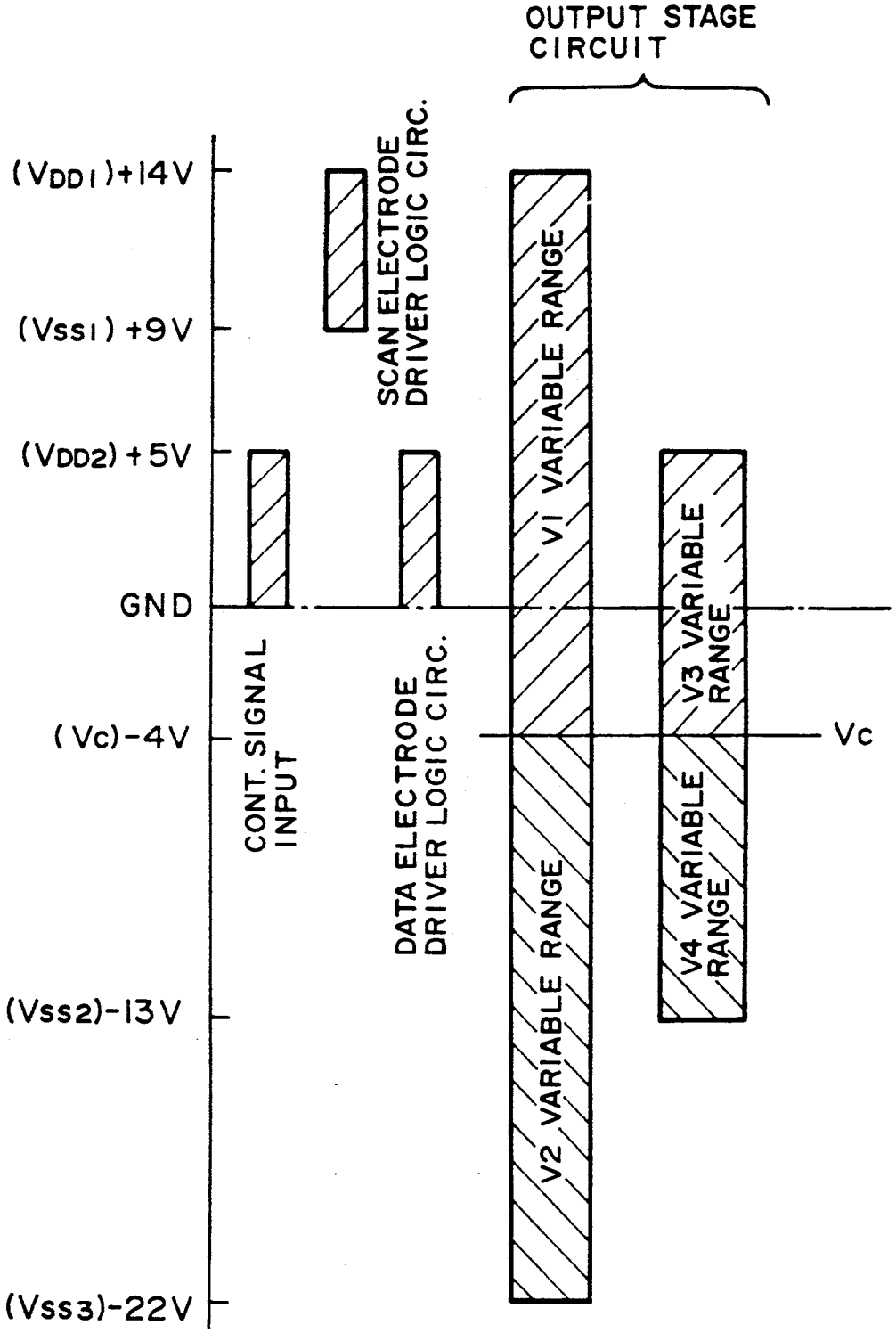
FIG. 2 is a graph showing a relationship of operation voltages and drive potentials in the present invention.

In the scanning electrode driver 12, the logic circuit is operated by a voltage of ($V_{DD1}-V_{SS1}$), and the output stage circuit is driven by a voltage of ($V_{DD1}-V_{SS3}$). In the data electrode driver 13, the logic circuit is operated by a voltage of ($V_{DD2}$−GND) and the output stage circuit is operated by a voltage of ($V_{DD2}-V_{SS2}$). In this embodiment, the scanning electrode driver 12 comprises a high-voltage process IC having a maximum rated voltage of 36 volts and including a logic circuit showing an operation frequency on the order of 30 kHz. Further, the data electrode driver 13 comprises a high-voltage process IC having a maximum rated voltage of 18 volts and including a logic circuit showing an operation frequency on the order of 5 MHz. In correspondence with this, the operational potential ranges and drive voltage ranges are set as shown in FIG. 2. The control signal uses an input voltage range of (+5 V−GND), and the operation voltage ranges are respectively set as follows: scanning electrode driver logic circuit ($V_{DD1}-V_{SS1}$)=(14 V−9 V), scanning electrode driver output stage circuit ($V_{DD1}-V_{SS3}$)=(14 V−(−22 V)), data electrode driver logic circuit ($V_{DD2}$−GND)=(5 V−0 V), data electrode output stage circuit ($V_{DD2}-V_{SS2}$)=(5 V−(−13 V)). From the above-mentioned drive voltage design, the central voltage Vc among the drive voltages become Vc=−4 V, and the variable ranges for the respective voltages are as follows: $V_1$=−4 V to +14 V, $V_3$=−4 V to +5 V, $V_4$=−4 V to −13 V, $V_2$=−4 V to −22 V.

Figure 3:
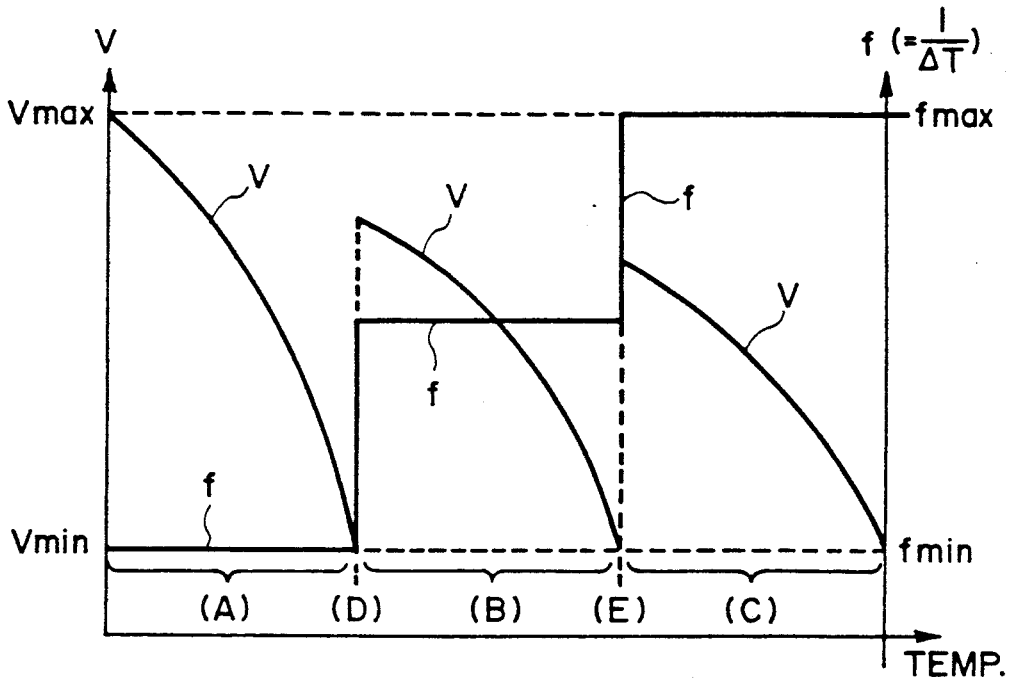
FIG. 3 is a diagram showing a relationship among temperature, drive voltage and frequency.
Figure 11:
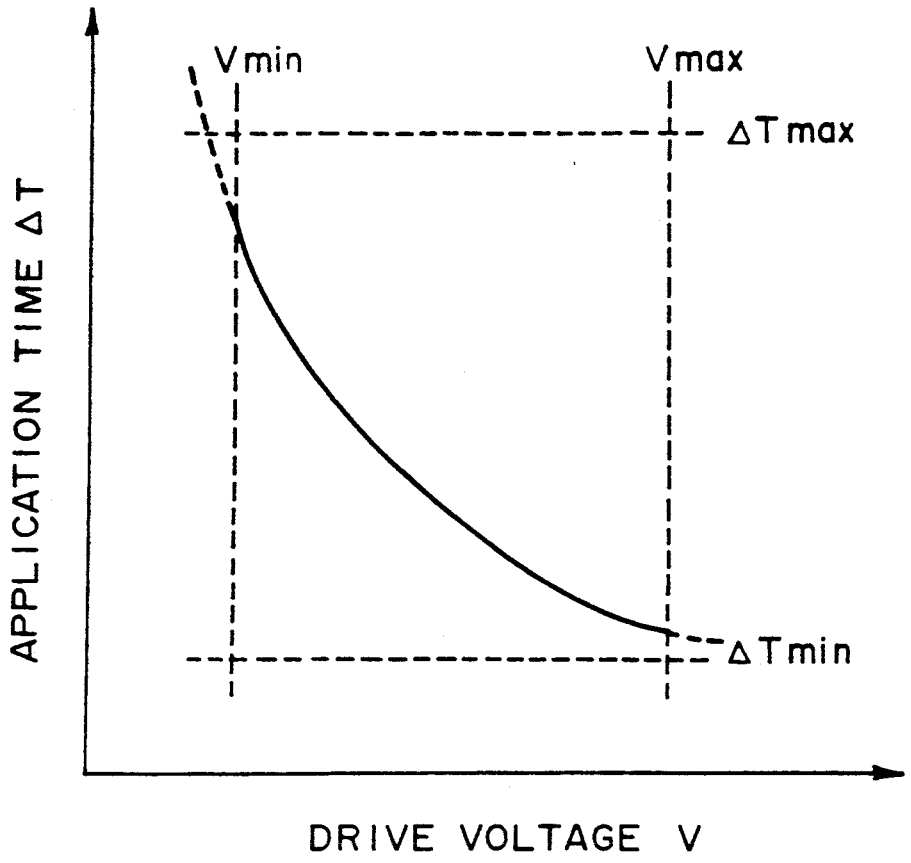
FIG. 11 is a characteristic chart showing a relationship between the drive voltage and application time for a ferroelectric liquid crystal panel.
Figure 12:
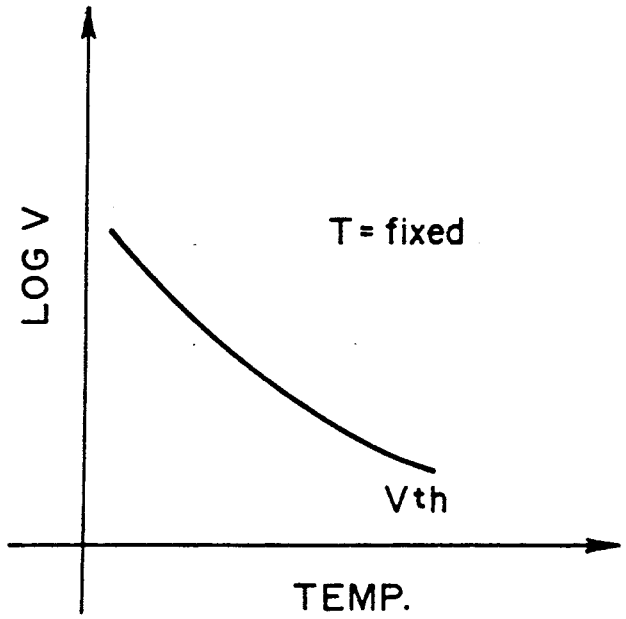
FIG. 12 is a characteristic chart showing a relationship between the temperature and drive voltage for a ferroelectric liquid crystal panel.

A temperature sensor 15 comprising a temperature-sensitive resistive element is disposed on the display panel 11, and the measured data therefrom are taken in a control circuit 17 through an A/D (analog/digital) converter 16. The measured temperature data are compared with a data table prepared in advance, and a pulse duration ΔT providing an optimum drive condition based on the comparison data is outputted as a control signal while a data providing a drive voltage $V_0$ is supplied to a D/A converter 19. The data table has been prepared in consideration of the characteristics shown in FIGS. 11 and 12. An example of such a data table reformulated in the form of a chart is shown in FIG. 3, wherein the abscissa represents the temperature Temp. and the ordinates represent the drive voltage $V_0$ and frequency f ($f=1/\Delta T$). As shown in FIG. 3, if a frequency f is fixed in a temperature range (A), the drive voltage $V_0$ decreases as the temperature Temp. increases until it becomes lower than Vmin. Accordingly, at a temperature (D), a larger frequency f is fixed and a drive voltage $V_0$ is determined corresponding thereto. Further, similar operation and re-setting are effected in temperature ranges (B) and (C) and at a temperature (E). The shapes of the curves thus depicted vary depending on the characteristics of a particular ferroelectric liquid crystal used, and the charts of f and V are determined corresponding thereto.

Figure 4A:
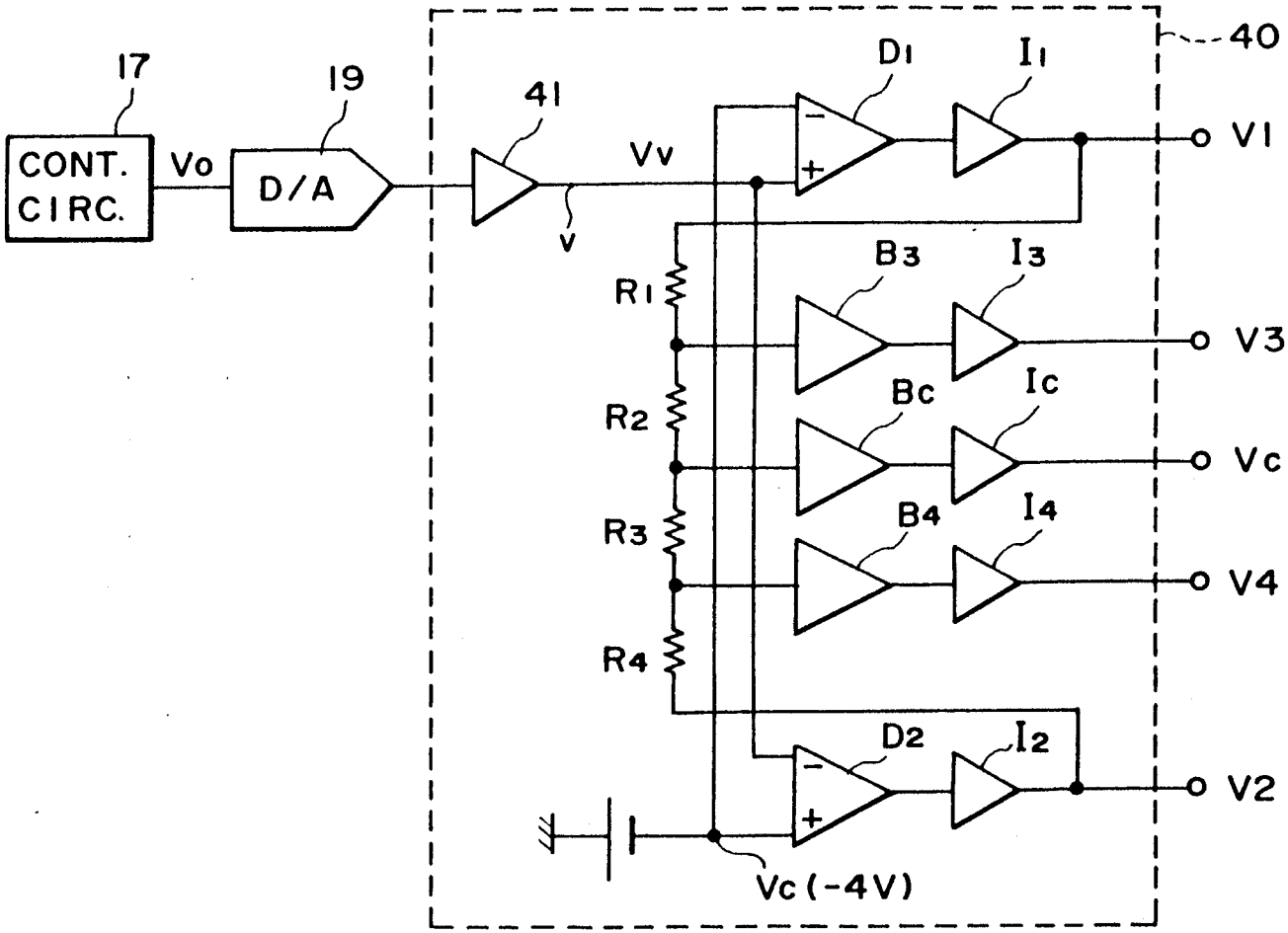
FIGS. 4A and 4B are circuit diagrams showing alternative embodiments of a driving apparatus of the present invention.
Figure 4B:
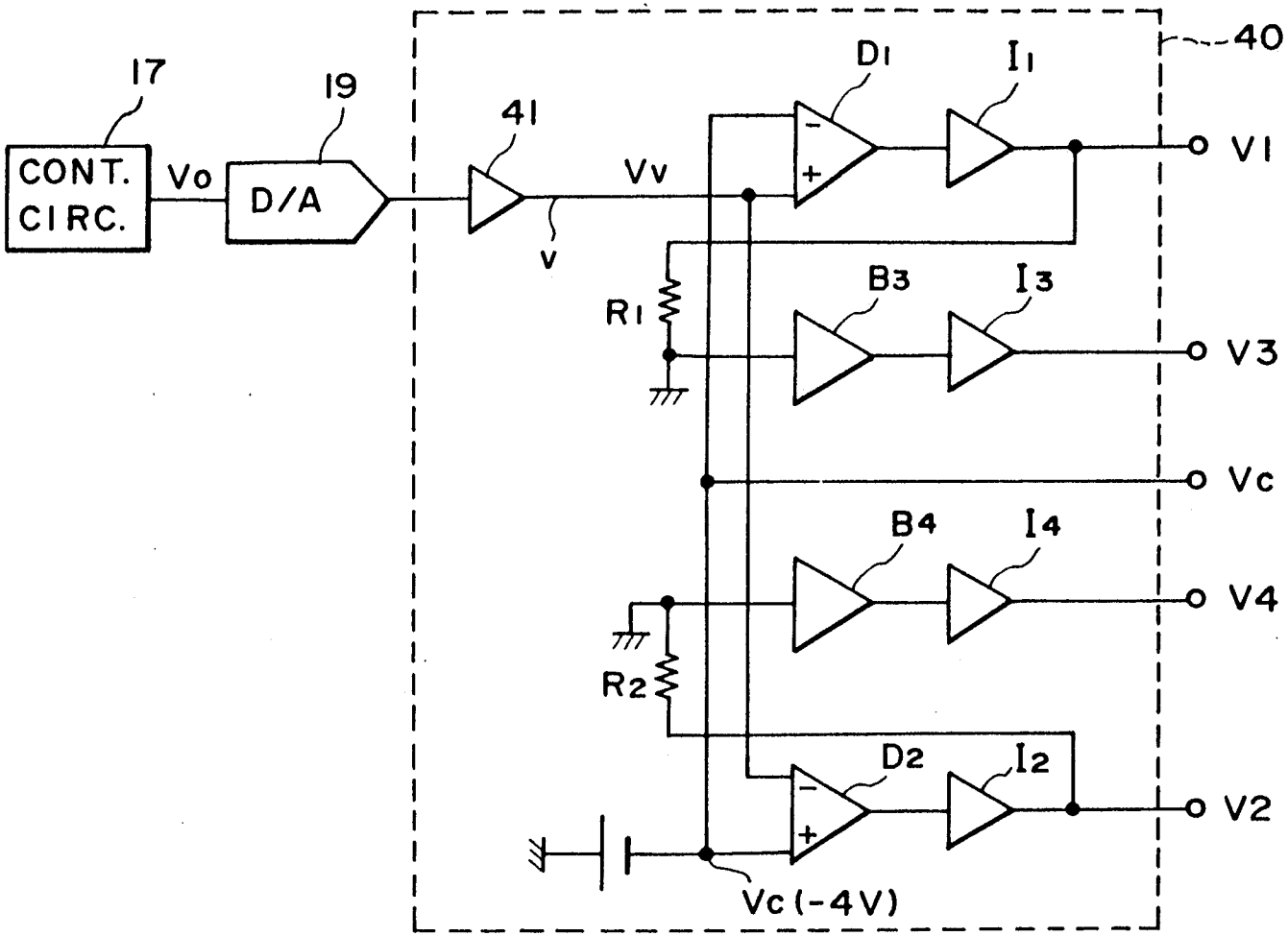
Figure 4C:
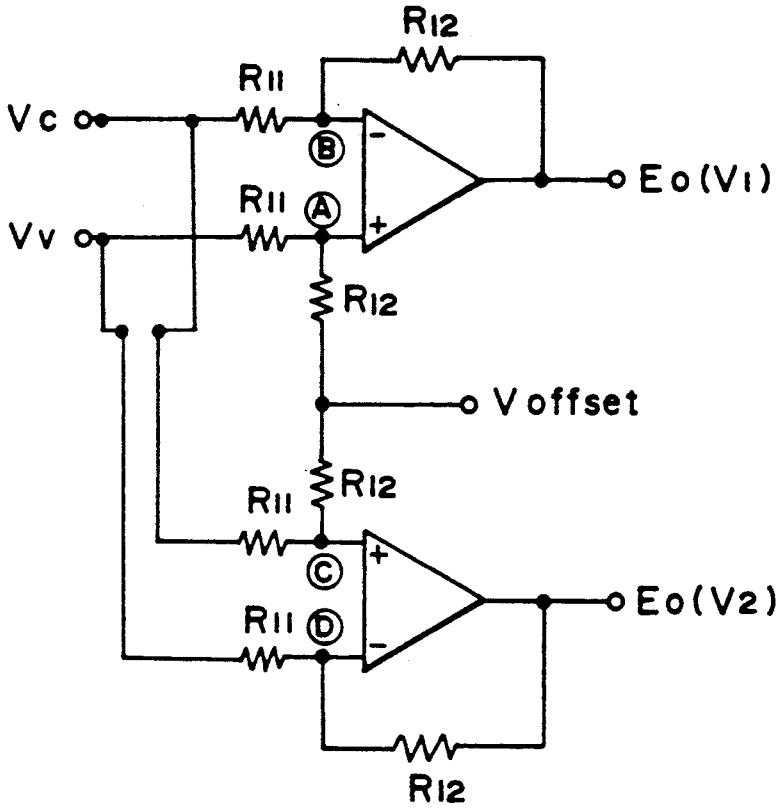
FIG. 4C is an equivalent circuit of different applifiers in FIG. 4A.

Next, a procedure of changing a set value of drive voltage $V_0$ in accordance with a temperature change is explained with reference to FIG. 4A, and FIG. 4C shows an equivalent circuit of differential amplifiers contained in FIG. 4A.

A digital drive voltage $V_0$ data from the control circuit 17 is supplied to the D/A converter 19 where it is converted into an analog data, which is then outputted as a voltage Vv onto a drive voltage control line v in a drive voltage generating circuit 40 in the power supply circuit 14 via a buffer amplifier 41. The drive voltage control line v is connected to differential amplifiers $D_1$ and $D_2$, where differentials between the voltage Vv and a fixed voltage Vc (= −4 V) are taken to output a voltage $V_1$ (=(Vv−Vc)+Vc) from the differential amplifier $D_1$ and a voltage $V_2$ (=(Vc−Vv)+Vc) from the differential amplifier $D_2$. In this instance, the output voltage $V_1$ from the differential amplifier $D_1$ and the output voltage $V_2$ from the differential amplifier $D_2$ are set to have a positive polarity and a negative polarity with respect to a standard voltage level set between the maximum value and minimum value of the supply voltage for driving the scanning electrode driver 12 and the data electrode driver 13.

Figure 10:
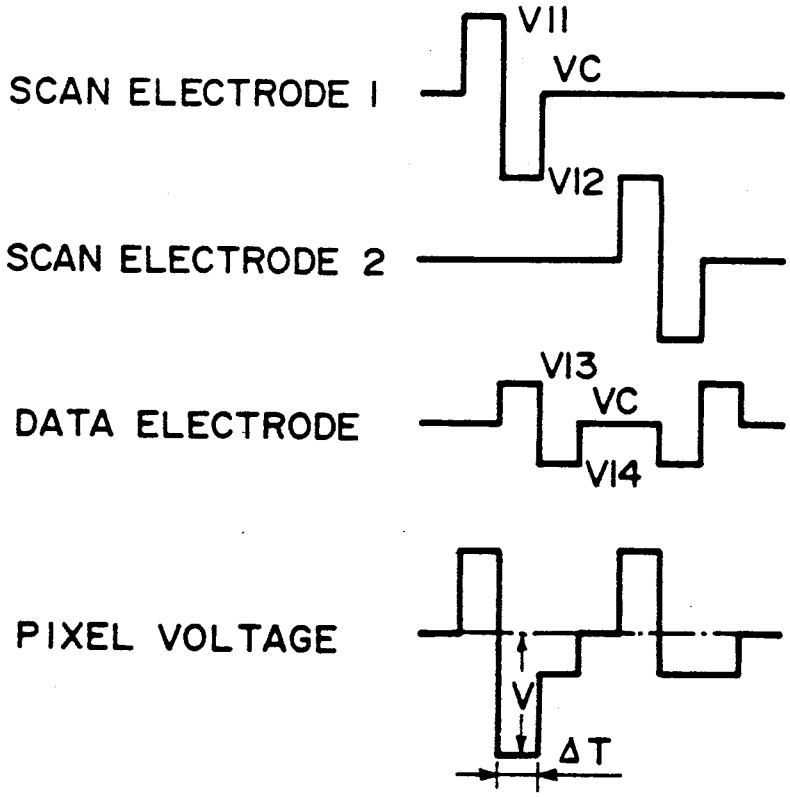
FIG. 10 is a waveform diagram showing driving waveforms for a ferroelectric liquid crystal panel as used in the present invention.

In this embodiment, the voltage Vv on the drive voltage control line v is set to satisfy a relationship of −4 V (Vc)≦Vv≦+14 V ($V_{DD1}$). In this embodiment, the voltage Vv is varied in the range of −4 V to +14 V depending on temperature data. Further, between the differential amplifiers' output $V_1$ and $V_2$, four voltage division resistors $R_1$, $R_2$, $R_3$ and $R_4$ are connected in series, and division voltages each for 1 resistor are outputted as output voltages $V_3$, Vc and $V_4$ in the order of higher to lower voltages. Then, these voltages are led to buffer operational amplifiers $B_3$, Bc and $B_4$. In this embodiment, in order to output drive voltages as shown in FIG. 10, the four resistors $R_1$, $R_2$, $R_3$ and $R_4$ are set to have the same resistance so as to provide ratios of voltages with respect to the potential Vc of $V_1:V_3:V_4:V_2=2:1:1:2$. The voltages generated by the differential amplifiers $D_1$, $D_2$ and buffer operational amplifiers $B_3$, Bc and $B_4$ are supplied to current amplifiers $I_1$, $I_2$, $I_3$, Ic and $I_4$, among the outputs from which $V_1$, Vc and $V_2$ are supplied to the scanning electrode driver, and $V_3$, Vc and $V_4$ are supplied to the data electrode driver.

According to FIG. 4C showing an equivalent circuit of the differential amplifiers $D_1$ and $D_2$ in FIG. 4A in a more generalized manner, a fixed voltage Vc provides a reference voltage for a voltage Vv which corresponds to an input voltage to the drive voltage generating circuit 40, and an offset voltage $V_{offset}$ provides a reference voltage for a voltage Eo which corresponds to an output voltage of the drive voltage generating circuit 40. As a result, the following equations are derived.

When $R_{11}=R_{12}$, the potentials P at points Ⓐ and Ⓑ are given by:

$$P_A=(Vv+V_{offset})/2,$$

$$P_B=(Vc+Eo(V_1))/2.$$

As the differential amplifiers $D_1$ and $D_2$ constitute imaginary short-circuit, $P_A=P_B$, that is, $$Vv+V_{offset}=Vc+Eo(V_1).$$

This leads to $Vv-Vc=Eo(V_1)=V_{offset}$.

On the other hand, the potentials at points Ⓒ and Ⓓ are given by:

$$P_C=(-Vv+V_{offset})/2,$$

$$P_D=(-Vc+Eo(V_2))/2.$$

Again $P_C=P_D$, so that $$-Vv+V_{offset}=-Vc+Eo\ (V_2),$$

which leads to $$-Vv+Vc=Eo(V_2)-V_{offset}.$$

Accordingly, when $R_{11}$ and $R_{12}$ are set to arbitrary values, the following equations are given:

$$Eo(V_1)-V_{offset}=-(R_{12}/R_{11})(Vc-Vv)$$

$$Eo(V_2)-V_{offset}=(R_{12}/R_{11})(Vc-Vv).$$

In an example set of voltages generated in the drive voltage generating circuit, the voltage Vv on the drive voltage control line is given as Vv=+6 V, Vc=−4 V, $V_{offset}$=Vc, $R_{11}=R_{12}$, and then the respective drive voltages are given as follows:

$$Eo(V_1)=-(Vc-Vv)+Vc(=V_{offset})=+6\ \text{V}$$

$$Eo(v_2)=(Vc-Vv)+Vc(=V_{offset})=-14\ \text{V}$$

$$V_3=(|V_1|+|V_2|)\times\tfrac{3}{4}+V_2+1\ \text{V}$$

$$V_4=(|V_1|+|V_2|)\times\tfrac{1}{4}+V_2-9\ \text{V}.$$

In the present invention, the offset voltage can be set to an arbitrary value, preferably in a range between the maximum output voltage and the minimum output voltage of the circuit 40, particularly the mid voltage in the range.

In the above embodiment, the current amplifiers $I_1$, $I_3$, Ic, $I_4$ and $I_2$ are provided so as to stably supply prescribed powers. In case of a TN-type liquid crystal device in general, a capacitor is simply disposed in parallel with each voltage division resistor as the capacitive load is small. In case of a ferroelectric liquid crystal showing a large capacitance, a voltage drop accompanying the load switching is not negligible. In order to solve the problem, the current amplifiers are disposed to provide larger power supplying capacities, thus providing a good regulation performance. Further, there is actually provided a circuit structure including feedback lines for connecting the outputs of the current amplifiers $I_1$–$I_4$ and Ic to the feed lines of the differential amplifiers $D_1$, $D_2$, buffer operational amplifiers $B_3$, $B_4$ and Bc, respectively, while not shown in FIG. 4, so as to remove a voltage drift of output voltages $V_1$–$V_4$ and Vc.

FIG. 4B shows another embodiment of the present invention wherein the output voltage $V_3$ is obtained by means of a voltage division resistor $R_1$ and the output voltage $V_4$ is obtained by means of a voltage division resistor $R_2$.

Figure 4D:
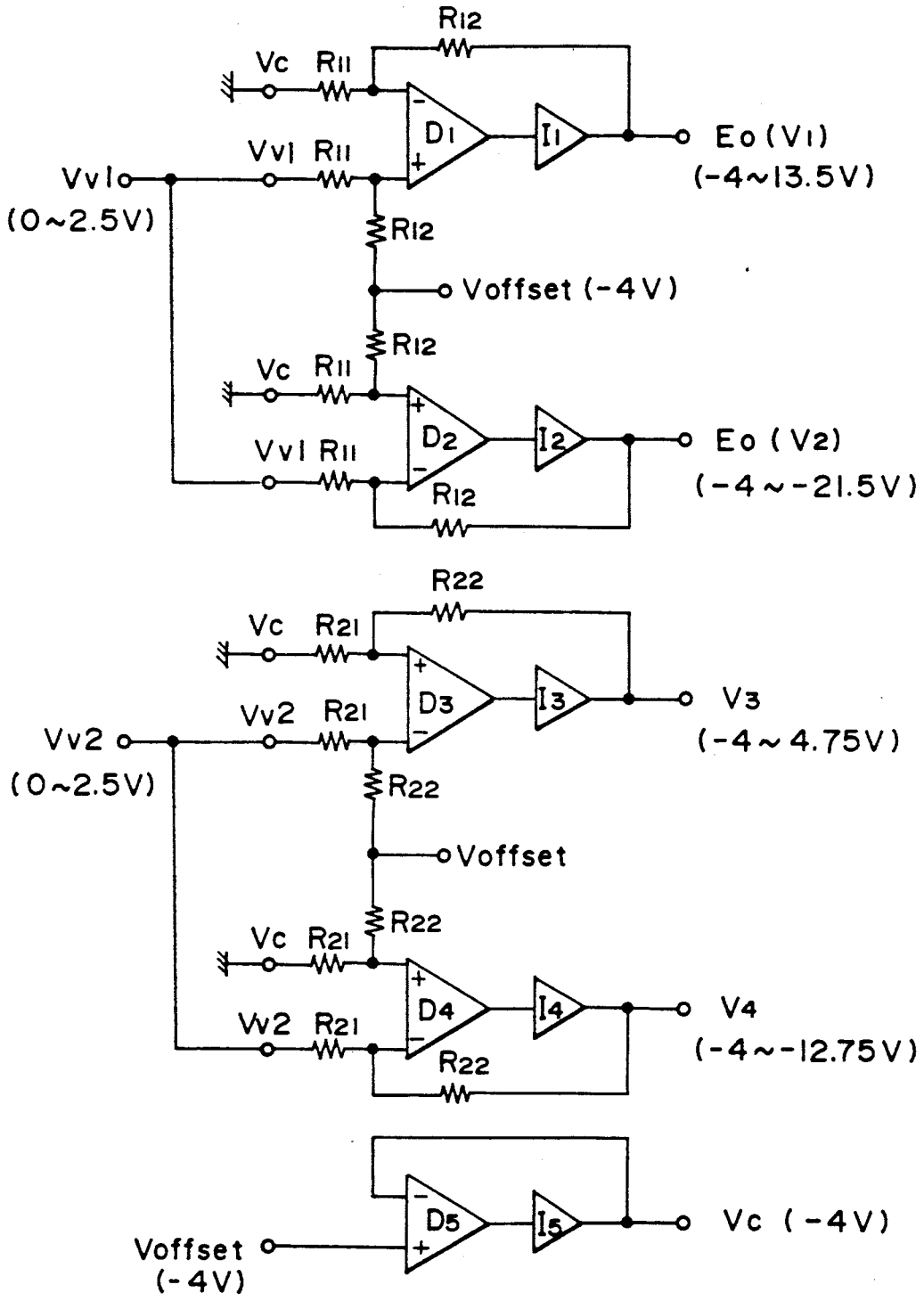
FIG. 4D is a circuit diagram showing another embodiment of the driving apparatus of the present invention.

FIG. 4D shows another embodiment of the present invention, wherein two source voltages Vv1 and Vv2 are used in combination with differential amplifiers $D_1$–$D_5$ and current amplifiers $I_1$–$I_5$. In this embodiment, the resistors are set to satisfy $R_{12}/R_{11}=7$, and $R_{22}/R_{21}=3.5$.

Figure 5:
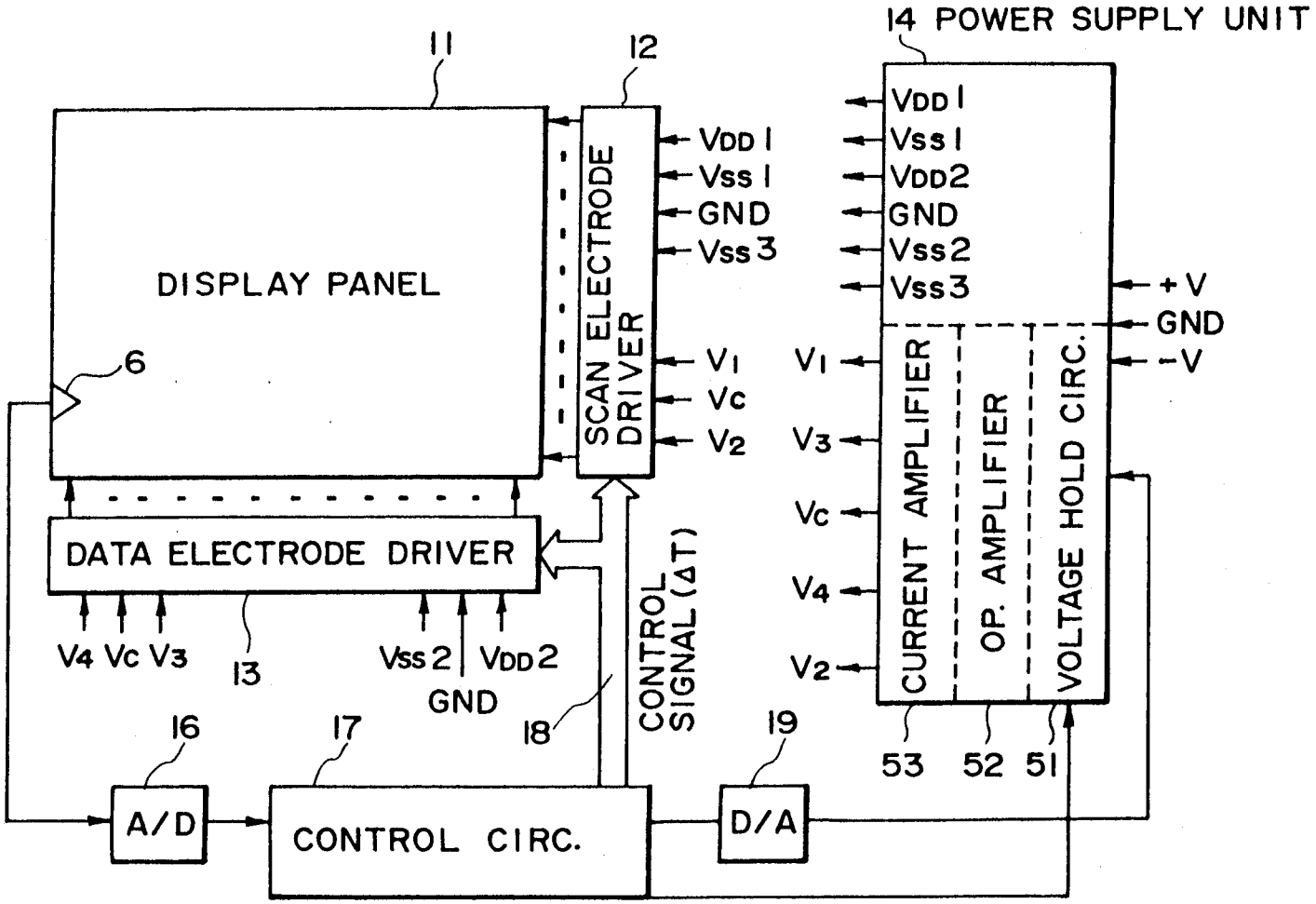
FIG. 5 is a block diagram of a display apparatus using another driving apparatus according to the present invention.

FIG. 5 shows another embodiment of the present invention, wherein a drive voltage generating circuit different from the one used in the power supply circuit 14 shown in FIG. 1 is used.

In this embodiment, a power supply circuit or unit 14 is provided with a voltage hold circuit 51, an operational amplifier 52 and a current amplifier 53. The voltage hold circuit 51 comprises mutually independent four circuits for the voltages $V_1$, $V_2$, $V_3$ and $V_4$, respectively. According to the circuit 51, prescribed voltages $V_1$, $V_2$, $V_3$ and $V_4$ serially outputted from a D/A converter 19 are sampled and held by the respective circuits to set four voltages.

Figure 6:
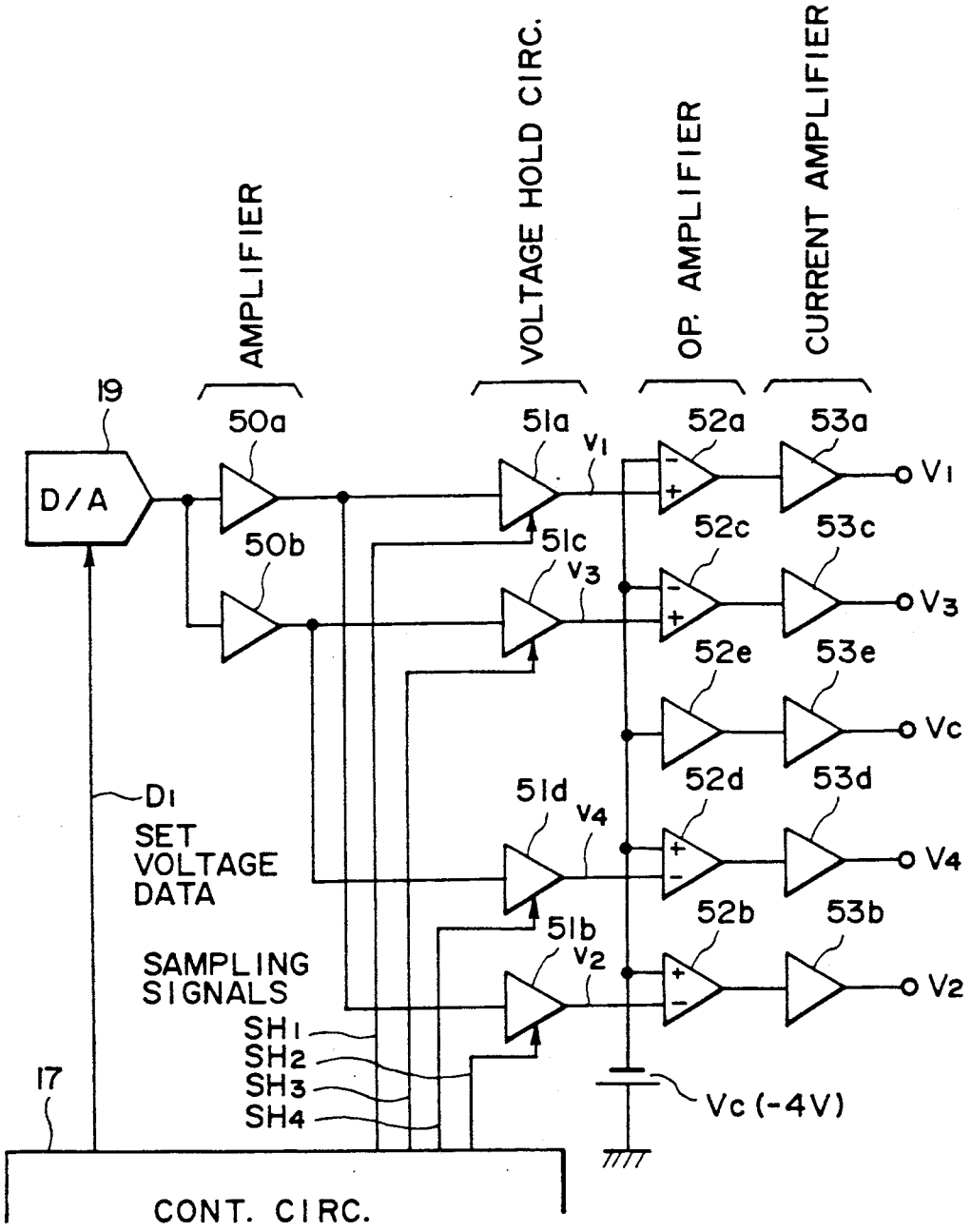
FIG. 6 is a circuit diagram of another power supply circuit used in the present invention.

FIG. 6 is a circuit diagram showing an example of the power supply circuit 14 according to this embodiment. More specifically, the power supply circuit 14 shown in FIG. 6 is one provided with a means for changing a set value of drive voltage in accordance with a temperature change, and comprises four stages including amplifiers 50*a*–50*b*, voltage hold circuits 51*a*–51*d*, operational amplifiers 52*a*–52*d*, and current amplifiers 53*a*–53*d*. As already described, set voltage data Di in the form of digital signals are sent from the above-mentioned control circuit 17 to a D/A converter 19, where the digital data are converted into analog data, which are then supplied to the voltage hold circuits 51*a*–51*d* via the amplifier 50*a* for $V_1/V_2$ and the amplifier 50*b* for $V_3/V_4$.

Figure 7:
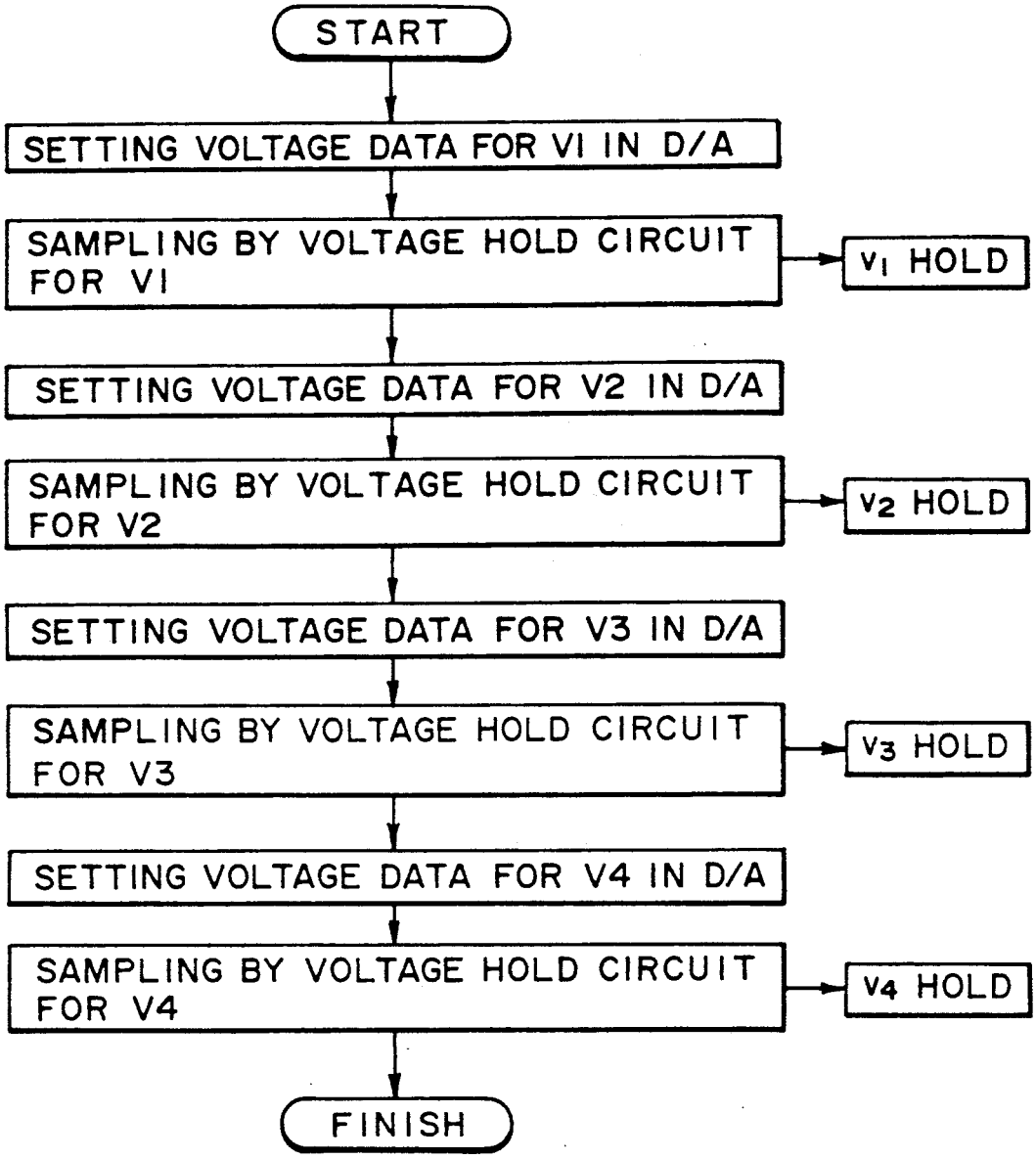
FIG. 7 is a flow chart of operation sequence for setting voltages used in the present invention.

FIG. 7 is a flow chart showing an example sequence of control operation for sampling and holding set voltages in the voltage hold circuit 51*a*–51*d*. In the control sequence, first of all as shown in FIG. 7, a set voltage for $V_1$ is set in the D/A converter 19, and a sampling signal $SH_1$ for $V_1$ is supplied to the voltage hold circuit 51*a* for $V_1$, where a set voltage $v_1$ for $V_1$ supplied through the amplifier 50*a* is sampled and held. Then, a similar operation is repeated by using sampling signals $SH_2$, $SH_3$ and $SH_4$ to hold set voltages $v_2$, $v_3$ and $v_4$ in the voltage hold circuits 51*b*, 51*c* and 51*d*, respectively.

Then, the voltages $v_1$, $v_2$, $v_3$ and $v_4$ set in the voltage hold circuits 51*a*, 51*b*, 51*c* and 51*d* are respectively supplied to the operational amplifiers 52*a*. 52*b*, 52*c* and 52*d*, respectively. The operational amplifiers 52*a*–52*d* are differential amplifiers similar to $D_1$ and $D_2$ in FIG. 4A, whereby the differentials between the set voltages $v_1$–$v_4$ and a fixed voltages Vc (= −4 V) are taken. In this embodiment, the respective set values are set to satisfy the ranges of $-4\ V \leqq v_1, v_2 \leqq 14\ V$, and $-4\ V \leqq v_3, v_4 \leqq 5\ V$. Accordingly, as a result of differential operation by means of the operational amplifiers 52*a*–52*d*, voltages $V_1$–$V_4$ are generated so as to satisfy the following conditions:

$$-4\ V \leqq V_1\ (=(v_1-v_c)+v_c) \leqq 14\ V$$

$$-22\ V \leqq V_2\ (=(v_c-v_2)+v_c) \leqq -4\ V$$

$$-4\ V \leqq V_3\ (=(v_3-v_c)+v_c) \leqq 5\ V$$

$$-13\ V \leqq V_4\ (=(v_c-v_4)+v_c) \leqq -4\ V.$$

Further, the voltages generated in the operational amplifiers 52*a*–52*d* and a voltage follower operation amplifier 52*e* for Vc are respectively supplied to the current amplifiers 53*a*–53*e*, from which the outputs $V_1$, Vc and $V_2$ are supplied to the scanning electrode driver 12 and the outputs $V_3$, Vc and $V_4$ are supplied to the data electrode driver 13. As described above, the current amplifiers 53*a*–53*e* are provided so as to stably supply required powers.

Figure 8:
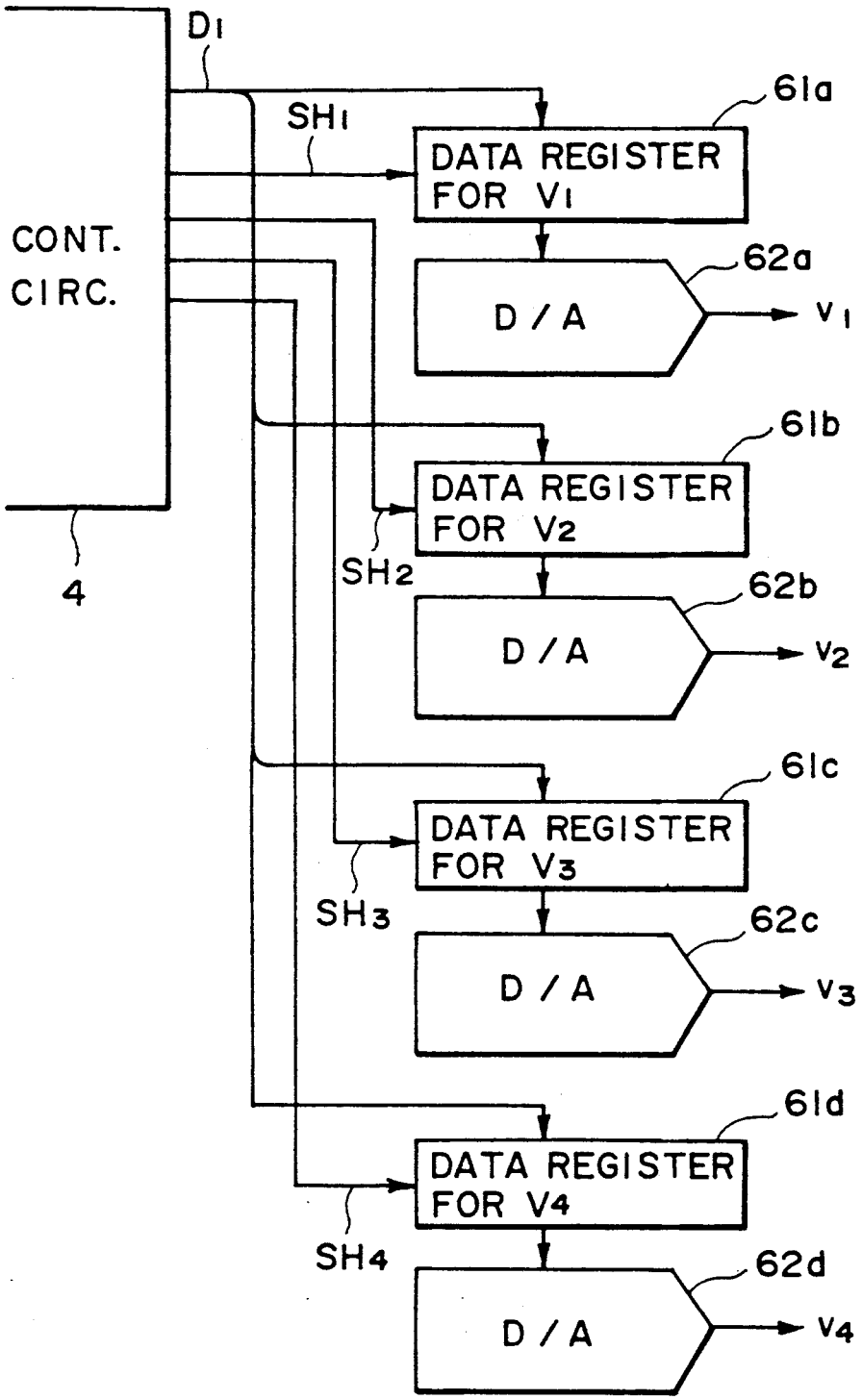
FIG. 8 is a circuit diagram of another power supply circuit used in the present invention.
Figure 9:
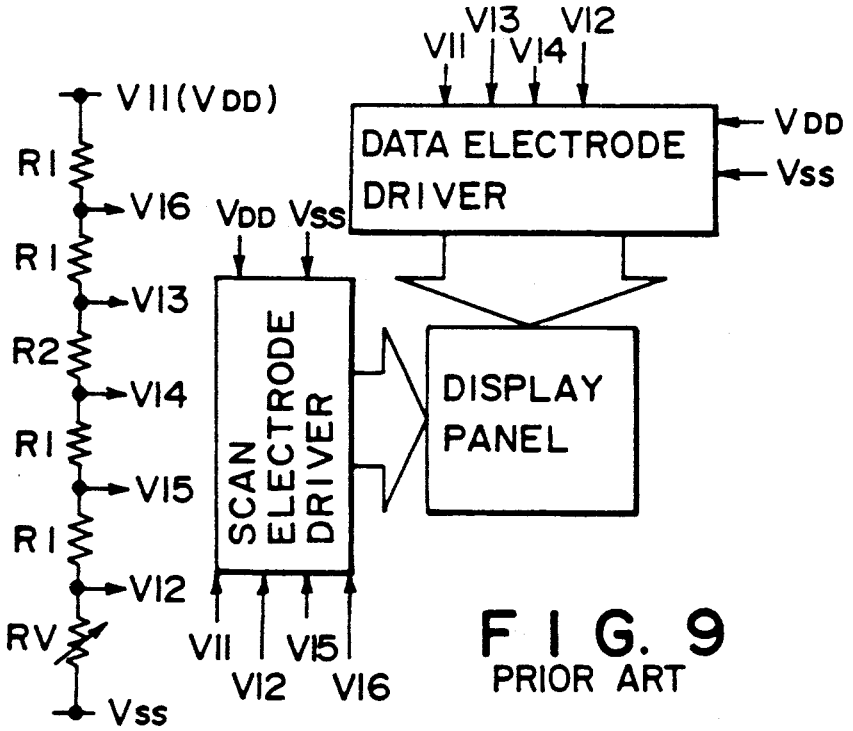
FIG. 9 PRIOR ART
FIG. 9 is a block diagram of a display apparatus using a conventional driving apparatus.

In the above described embodiment, analog voltages are retained in the voltage hold circuits. The present invention is, of course, not restricted to this mode, but it is possible to hold digital set voltages Di as they are for providing drive voltages. FIG. 8 is a circuit diagram of a voltage hold circuit for such an embodiment. Referring to FIG. 8, the voltage hold circuit comprises 4 sets of a data register and a D/A converter. When sampling signals $SH_1$–$SH_4$ are supplied from the control circuit 17, set voltage data Di are stored in data registers 61*a*–61*d* for voltages $V_1$–$V_4$. The data in the data registers 61*a*–61*d* are supplied to the D/A converters 62*a*–62*d* respectively connected thereto and then outputted as the above-mentioned hold voltages $v_1$–$v_4$ in analog form.

As described above, according to the present invention, differentials between hold voltages $v_1$–$v_4$ generated from set voltage data for providing voltages $V_1$–$V_4$ and a fixed voltage Vc are respectively taken to provide positive voltages $V_1$, $V_3$ and negative voltages $V_4$, $V_2$ with respect to the fixed voltage Vc as the reference. According to this voltage generating system, even if a scanning electrode driver and a data electrode driver having different rated or withstand voltages are used, maximum drive voltages with the respective withstand voltage limits can be outputted as different in a conventional voltage division by means of resistors. Further, the above four kinds of drive voltages can be independently varied, so that a broad freedom is provided in drive voltage control for temperature compensation. Further, it is not necessary to use a data electrode driver having an excessively high withstand voltage which may result in a lower operation speed.

In a preferred embodiment of the present invention, a ferroelectric liquid crystal panel may be used as the display panel 11. In the present invention, it is also possible to use driving waveforms disclosed in, e.g., U.S. Pat. Nos. 4,655,561 and 4,709,995 in addition to those shown in FIG. 10.

What is claimed is:

1. A driving apparatus, comprising:

a) a driving unit including a scanning electrode driver and a data electrode driver for driving an electrode matrix formed of scanning electrodes and data electrodes, and b) a drive voltage generating unit including a first means for generating a fixed voltage, a second means for generating a source voltage for providing drive voltages for driving the electrode matrix, and a third means for generating a first voltage equal to a subtraction of the fixed voltage from the source voltage and a second voltage equal to a subtraction of the source voltage from the fixed voltage, wherein the first voltage and the second voltage are of mutually opposite polarities with respect to the fixed voltage, and the fixed voltage is a voltage set to an intermediate value between a maximum output voltage and a minimum output voltage of the drive voltage generating unit.

2. An apparatus according to claim 1, wherein said drive voltage generating unit includes means for generating voltages equal to additions of an offset voltage to the first voltage and the second voltage, respectively.

3. An apparatus according to claim 2, wherein said offset voltage is equal to the fixed voltage.

4. An apparatus according to claim 1, wherein said third means includes means for generating division voltages between the first and second voltages.

5. An apparatus according to claim 1, wherein said third means includes a plurality of resistors arranged in series between the output stage for generating the first voltage and the output stage for generating the second voltage.

6. An apparatus according to claim 1, wherein said fixed voltage is a mid voltage between the maximum output voltage and the minimum output voltage of the drive voltage generating unit.

7. A liquid crystal apparatus, comprising:

a) a driving apparatus according to claim 1, and b) a liquid crystal panel comprising a first substrate having scanning electrodes thereon, a second substrate having data electrodes thereon, and a liquid crystal disposed between the first and second substrates.

8. A liquid crystal apparatus according to claim 7, wherein said liquid crystal is a chiral smectic liquid crystal.

9. A liquid crystal apparatus according to claim 8, wherein said chiral smectic liquid crystal is a liquid crystal having ferroelectric properties.

10. A liquid crystal apparatus according to claim 9, wherein said liquid crystal having ferroelectric properties is bistable.

11. A driving apparatus, comprising:

a) a driving unit including a scanning electrode driver and a data electrode driver for driving an electrode matrix formed of scanning electrodes and data electrodes, b) a drive voltage generating unit including a first means for generating a fixed voltage, a second means for generating a source voltage for providing drive voltages for driving the electrode matrix, and a third means for generating a first voltage equal to a subtraction of the fixed voltage from the source voltage and a second voltage equal to a subtraction of the source voltage from the fixed voltage, and c) control means for controlling the drive voltage generating means so that the first and second voltages will be prescribed voltages varying depending on an external temperature, wherein the first voltage and the second voltage are of mutually opposite polarities with respect to the fixed voltage, and the fixed voltage is a voltage set to an intermediate value between a maximum output voltage and a minimum output voltage of the drive voltage generating unit.

12. An apparatus according to claim 11, wherein said drive voltage generating unit includes means for generating voltages equal to additions of an offset voltage to the first voltage and the second voltage, respectively.

13. An apparatus according to claim 12, wherein said offset voltage is equal to the fixed voltage.

14. An apparatus according to claim 11, wherein said third means includes means for generating division voltages between the first and second voltages.

15. An apparatus according to claim 11, wherein said third means includes a plurality of resistors arranged in series between the output stage for generating the first voltage and the output stage for generating the second voltage.

16. A driving apparatus, comprising:

a) a driving unit including a scanning electrode driver and a data electrode driver for driving an electrode matrix formed of scanning electrodes and data electrodes, b) a drive voltage generating unit including a first means for generating a fixed voltage, a second means for generating a source voltage for providing drive voltages for driving the electrode matrix, and a third means for generating a first voltage equal to a subtraction of the fixed voltage from the source voltage and a second voltage equal to a subtraction of the source voltage from the fixed voltage, and c) control means for controlling said second means so that said source voltage will be a prescribed voltage varying depending on an external temperature, wherein the first voltage and the second voltage are of mutually opposite polarities with respect to the fixed voltage, and the fixed voltage is a voltage set to an intermediate value between a maximum output voltage and a minimum output voltage of the drive voltage generating unit.

17. An apparatus according to claim 16, wherein said drive voltage generating unit includes means for generating voltages equal to additions of an offset voltage to the first voltage and the second voltage, respectively.

18. An apparatus according to claim 17, wherein said offset voltage is equal to the fixed voltage.

19. An apparatus according to claim 16, wherein said third means includes means for generating division voltages between the first and second voltages.

20. An apparatus according to claim 16, wherein said third means includes a plurality of resistors arranged in series between the output stage for generating the first voltage and the output stage for generating the second voltage.

21. A driving apparatus, comprising:

a) a driving unit including a scanning electrode driver and a data electrode driver for driving an electrode matrix formed of scanning electrodes and data electrodes, and b) a drive voltage generating unit including a first means for holding a plurality of different voltages, a second means for generating a fixed voltage, and a third means for generating a plurality of voltages each obtained from one voltage of the plurality of the different voltages either by subtracting the fixed voltage from the one voltage or by subtracting the one voltage from the fixed voltage, wherein at least one of said plurality of different voltages has a polarity opposite to that of the other of said plurality of different voltages with respect to the fixed voltage, and the fixed voltage is a voltage set to an intermediate value between a maximum output voltage and a minimum output voltage of the drive voltage generating unit.

22. An apparatus according to claim 21, wherein said drive voltage generating unit includes means for generating voltages equal to additions of an offset voltage to the voltage obtained by the subtraction.

23. An apparatus according to claim 21, which includes a control means; said first means including a plurality of voltage holding means, and the control means controlling the plurality of holding means so that they will respectively hold one of the plurality of voltages which are serially supplied.

24. An apparatus according to claim 21, wherein said first means comprises a data register and a digital-/analog converter.

25. An apparatus according to claim 21, wherein said third means generates a maximum voltage and a minimum voltage which are of mutually opposite polarities with respect to the fixed voltage.

26. An apparatus according to claim 21, wherein said fixed voltage is a mid voltage between the maximum output voltage and the minimum output voltage of the drive voltage generating unit.

27. A liquid crystal apparatus, comprising:

a) a driving apparatus according to claim 21, and b) a liquid crystal panel comprising a first substrate having scanning electrodes thereon, a second substrate having data electrodes thereon, and a liquid crystal disposed between the first and second substrates.

28. A liquid crystal apparatus according to claim 27, wherein said liquid crystal is a chiral smectic liquid crystal.

29. A liquid crystal apparatus according to claim 28, wherein said chiral smectic liquid crystal is a liquid crystal having ferroelectric properties.

30. A liquid crystal apparatus according to claim 29, wherein said liquid crystal having ferroelectric properties is bistable.

31. A driving apparatus, comprising:

a) a driving unit including a scanning electrode driver and a data electrode driver for driving an electrode matrix formed of scanning electrodes and data electrodes, b) a drive voltage generating unit including a first means for holding a plurality of different voltages, a second means for generating a fixed voltage, and a third means for generating a plurality of voltages each obtained from one voltage of the plurality of the different voltages either by subtracting the fixed voltage from the one voltage or by subtracting the one voltage from the fixed voltage, and c) control means for controlling the drive voltage generating means so that the plurality of voltages obtained by the subtraction will be prescribed voltages varying depending on an external temperature, wherein at least one of said plurality of different voltages has a polarity opposite to that of the other of said plurality of different voltages with respect to the fixed voltage, and the fixed voltage is a voltage set to an intermediate value between a maximum output voltage and a minimum output voltage of the drive voltage generating unit.

32. An apparatus according to claim 31, wherein said drive voltage generating unit includes means for generating voltages equal to additions of an offset voltage to the plurality of the voltages obtained by the subtraction, respectively.

33. An apparatus according to claim 31, which includes a control means; said first means including a plurality of voltage holding means, and the control means controlling the plurality of holding means so that they will respectively hold one of the plurality of voltages which are serially supplied.

34. An apparatus according to claim 31, wherein said first means comprises a data register and a digital-/analog converter.

35. An apparatus according to claim 31, wherein said third means generates a maximum voltage and a minimum voltage which are of mutually opposite polarities with respect to the fixed voltage.

36. An apparatus according to claim 31, wherein said third means generates a maximum voltage and a minimum voltage which are of mutually opposite polarities with respect to the fixed voltage.

37. A driving apparatus, comprising:

a) a driving unit including a scanning electrode driver and a data electrode driver for driving an electrode matrix formed of scanning electrodes and data electrodes, b) a drive voltage generating unit including a first means for holding a plurality of different voltages, a second means for generating a fixed voltage, and a third means for generating a plurality of voltages each obtained from one voltage of the plurality of the different voltages either by subtracting the fixed voltage from the one voltage or by subtracting the one voltage from the fixed voltage, and c) control means for controlling the drive voltage generating means so that the plurality of different voltages held by the first means will be prescribed voltages varying depending on an external temperature, wherein at least one of said plurality of different voltages has a polarity opposite to that of the other of said plurality of different voltages with respect to the fixed voltage, and the fixed voltage is a voltage set to an intermediate value between a maximum output voltage and a minimum output voltage of the drive voltage generating unit.

38. An apparatus according to claim 37, wherein said drive voltage generating unit includes means for generating voltages equal to additions of an offset voltage to the plurality of the voltages obtained by the subtraction, respectively.

39. An apparatus according to claim 37, further comprising a holding control means, wherein said first means comprises a plurality of voltage holding means, and wherein said holding control means controls said plurality of holding means so as to respectively hold one of the plurality of different voltages which are serially supplied.

40. An apparatus according to claim 37, wherein said first means comprises a data register and a digital-/analog converter.

* * * * *

UNITED STATES PATENT AND TRADEMARK OFFICE

CERTIFICATE OF CORRECTION

PATENT NO. : 5,066,945

DATED : November 19, 1991

INVENTOR(S) : HIDEO KANNO, ET AL.

It is certified that error appears in the above-identified patent and that said Letters Patent is hereby corrected as shown below:

COLUMN 1

Line 12, "multiple" should read --multiplex--.
Line 60, "$V_{11}:V_{12}:V_{13}:V_{14}=2:1:1$" should read --$V_{11}:V_{12}:V_{13}:V_{14}=2:2:1:1$--.

COLUMN 2

Line 18, "are required," should be deleted.

COLUMN 4

Line 13, "a pixel" should be deleted.
Line 14, "electrodes." should read --electrodes a pixel.--.
Line 16, "polarity," should read --polarity--.
Line 57, "become" should read --becomes--.

COLUMN 6

Line 18, "$Vv - Vc = Eo(V_1) = V_{offset}$." should read --$Vv - Vc = Eo(V_1) - V_{offset}$.--.
Line 48, "$Eo(v_2)$" should read --$Eo(V_2)$--.
Line 50, "$V_2 + 1V$" should read --$V_2 = +1V$--.
Line 52, "$V_2$- -9V." should read --$V_2 = -9V$.--.

COLUMN 7

Line 49, "circuit 51a-51d." should read --circuits 51a-51d.--.
Line 64, "voltages" should read --voltage--.

UNITED STATES PATENT AND TRADEMARK OFFICE

CERTIFICATE OF CORRECTION

PATENT NO. : 5,066,945

DATED : November 19, 1991

INVENTOR(S) : HIDEO KANNO, ET AL.

It is certified that error appears in the above-identified patent and that said Letters Patent is hereby corrected as shown below:

COLUMN 8

Line 12, "operation" should read --operational--.
Line 20, "above described" should read --above-described--.

COLUMN 9

Line 28, "mid voltage" should read --mid-voltage--.

COLUMN 11

Line 24, "mid voltage" should read --mid-voltage--.

Signed and Sealed this

Twentieth Day of July, 1993

*Attest:*

Michael K. Kirk

MICHAEL K. KIRK

*Attesting Officer*

*Acting Commissioner of Patents and Trademarks*